United States Patent [19]

Priefert

[11] Patent Number: 4,509,577

[45] Date of Patent: Apr. 9, 1985

[54] CHAIN GATE STRUCTURE

[75] Inventor: Marvin J. Priefert, Mount Pleasant, Tex.

[73] Assignee: Priefert Mfg. Co., Inc., Mount Pleasant, Tex.

[21] Appl. No.: 549,161

[22] Filed: Nov. 7, 1983

[51] Int. Cl.[3] ..... E05C 5/00

[52] U.S. Cl. ..... 160/328; 49/34

[58] Field of Search ..... 160/327, 328, 329, 332; 49/34; 119/11, 99; 256/23, 38, 46, 73, DIG. 2

[56] References Cited

U.S. PATENT DOCUMENTS

| | | | |
|---|---|---|---|
| 353,368 | 11/1886 | Miller | 49/34 |
| 1,481,044 | 1/1924 | Ware | 160/328 |
| 1,642,875 | 9/1927 | Fitch et al. | 160/328 |
| 1,790,304 | 1/1931 | House | 49/34 |
| 3,099,249 | 7/1963 | Neuhouse, Jr. | 119/99 |

FOREIGN PATENT DOCUMENTS

| | | | |
|---|---|---|---|
| 1926385 | 11/1970 | Fed. Rep. of Germany | 49/34 |

*Primary Examiner*—Peter M. Caun

*Attorney, Agent, or Firm*—Rudolph L. Lowell

[57] ABSTRACT

The chain gate has a pair of reversely inclined end posts which extend upwardly in a diverging relation and movably support the ends of a plurality of chain members extended therebetween. When the chain gate is in a gateway closing position the chain members are in a vertically spaced relation and in a gateway opening position the chain members form a mass on the ground surface between the end posts. The adjacent ends of the chain members are interconnected by a flexible actuating member so that on closing upward movement of the chain members from lowered ground positions the opposite ends of each chain member are concurrently moved upwardly so as to sequentially move the chain members to their horizontally extended vertically spaced relation defining the gate closing position. The chain members vary in length relative to the reversed inclination of the end posts so as to be drawn taut between the end posts in the gate closing position. The chain gate may be opened or closed either mechanically or manually.

5 Claims, 16 Drawing Figures

20
21
22
23
24
26
27
28
29
31
32
33
34
36
37
38
39
41
42
43
44
46
47
48
49
51
52
53
54
56
57
58
59
61
62
67
68
69
70
71
72
73
75
77
3
4

CHAIN GATE STRUCTURE

BACKGROUND OF THE INVENTION

Gate structures in the agricultural field are usually of a swinging hinge type that are manually releasably locked and then manually swung to open and closed positions therefor. Mounting and dismounting from a vehicle to be driven through the gateway is thus required at each side of the gateway. As a result, the use of these hinge gates is both inconvenient and objectionable and especially when undue manual effort is required in some instances to handle the gate.

Chain gates have been used to overcome the inconvenience of handling hinge gates by virtue of their adaptability to be generally vertically movable to gateway opening and closing positions therefor. In this respect, chain members extendable across the gateway are collapsed to a gateway opening position and elevated to extend thereacross in a gateway closing position. However, these prior chain gate devices have not been generally successful due to the chain members or the actuating devices therefor having a tendency to become entangled during movement of the chain members between open and closing positions. Thus, for example, the chain structure of U.S. Pat. No. 1,642,875 has one end thereof hung from an adjacent end post for manipulation of its opposite end to gateway opening and closing positions. In the gate structure of U.S. Pat. No. 1,481,044, both ends of the chain structure are secured to end posts which are then swingable in the same direction to ground supported positions when the gate is in the open position therefor. The gate structure is thus longer than the width of the gateway by an amount equal to the height of an end post. These disadvantages are eliminated by the gate structure of the present invention.

SUMMARY OF THE INVENTION

The chain gate of the present invention is easily and efficiently operated from either side thereof for manual actuation, or by power means actuated in response to the travel of a vehicle through the gateway. The chain gate has horizontal chain members supported at their opposite ends for free up and down movement on adjacent end posts. The adjacent ends of the chain members are interconnected so that the chain members are sequentially moved between raised and collapsed positions therefor in response to the raising and lowering of the uppermost chain member in the gate structure. By virtue of the end posts being inclined upwardly in a diverging relation the horizontal chain members become relaxed on a lowering thereof to collapsed positions and tensioned on a raising thereof to gateway closing positions. The chain members, when the gate is collapsed, form a compact mass on the ground surface between the end posts and are sequentially moved, while horizontally extended, to their respective raised positions in a vertically spaced relation between the end posts.

DESCRIPTION OF THE INVENTION

Figures 1, 2, 3:
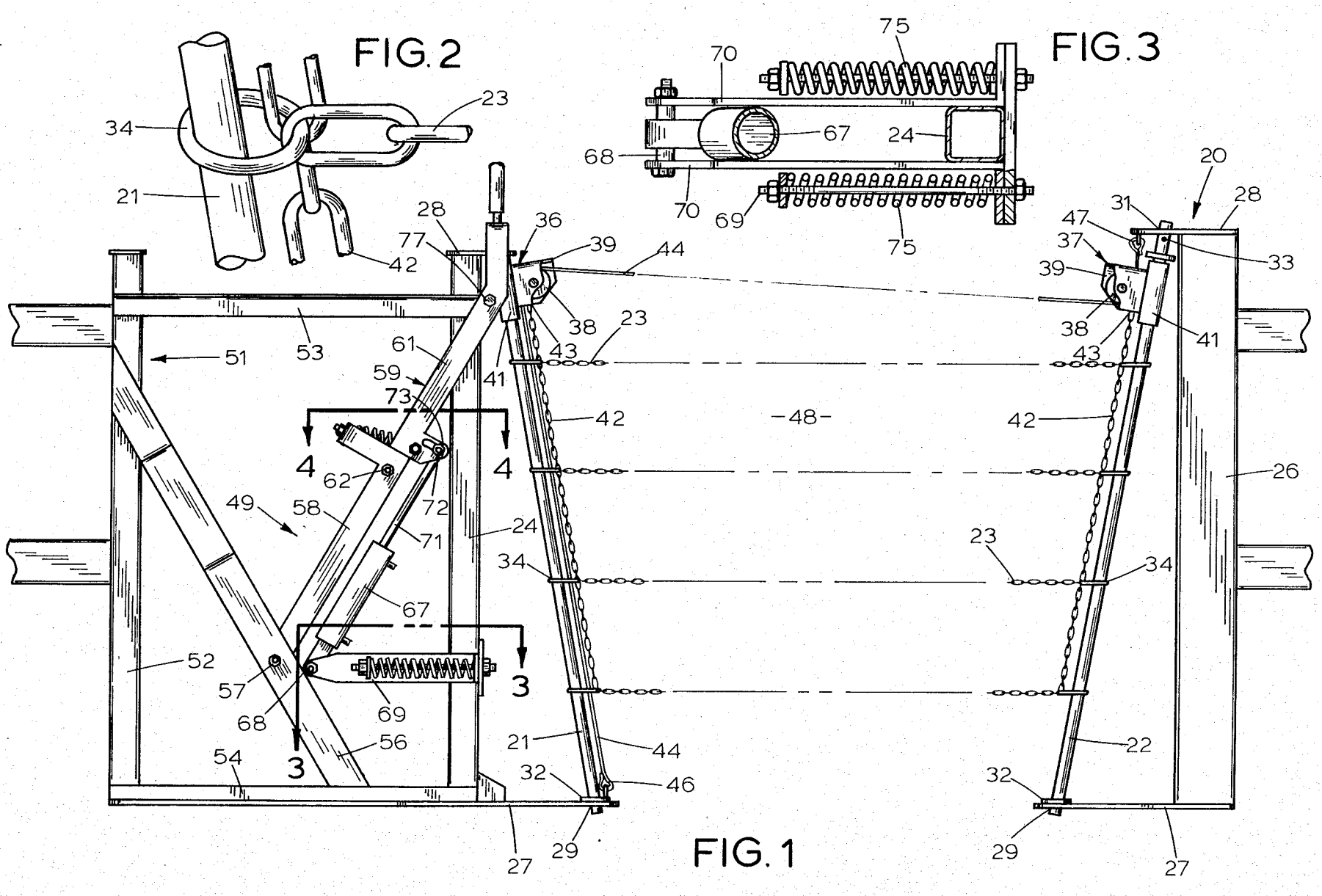
FIG. 1 is a foreshortened side elevational view of the chain gate structure of this invention shown in a gateway closing position.
FIG. 2 is an enlarged detail perspective view showing the interconnection of a chain member with an end post and an adjacent chain member.
FIG. 3 is an enlarged sectional view of a spring assembly as seen on the line 3—3 in FIG. 1.

With reference to FIG. 1, the chain gate of this invention, indicated generally at 20, includes a pair of end posts 21 and 22 and a plurality of chain members 23 connected to and extendible between the end posts. In a gateway closing position, the chain members 23 are extended horizontally in a vertically spaced relation between the end posts 21 and 22 which are secured in an upwardly diverging relation to associated standards or anchor posts 24 and 26, respectively, of a tubular metal construction. Each anchor post 24 and 26 is provided with a bottom base plate 27 and a top mounting plate 28 which project inwardly toward an adjacent end post 21 or 22 with the base plate 27 projected inwardly a greater distance than the top plate 28.

Each plate 27 and 28 is provided adjacent the inner terminal end thereof with an opening 29 and 31, respectively. An end post 21 and 22 has the lower end thereof insertable within an opening 29 and the upper end thereof within an opening 31 to provide for the inclination of an end post in a direction inclined upwardly and toward an associated anchor post 24 and 26, respectively. A stop collar 32 adjacent the lower end of an end post supports the end post on an associated base plate 27. A cotter key 33 extended through each end post adjacent the lower side of a top plate 28 holds the end post in assembly relation with an associated anchor post. On the removal of a cotter key 33 it is seen that the lower end of an end post is removable from an opening 29 to permit removal of the top end thereof from the opening 31.

The chain gate 20 is illustrated as having four chain members 23 with each chain member (FIGS. 1 and 2) having end rings 34 loosely mounted about an end post for free movement axially thereof. Located above the chain members 23 and slidably movable on the end posts 21 and 22 are pulley units 36 and 37, respectively, each of which includes a pulley 38 rotatably mounted within an inverted U-shape housing 39 that is rigidly secured, as by weldments, to a tubular sleeve or bearing member 41 mounted about an associated end post for free up and down sliding movement thereon. The ring members 34 at the ends of each of the chain members 23 are interconnected by associated lift chains 42, each of which has an upper section 43 secured to the underside of the housing 39 of an adjacent pulley unit 36 and 37.

A cable 44 (FIG. 1) for concurrently controlling the movement of the pulley units 36 and 37 longitudinally of the end posts 21 and 22 is of a length, when the gate 20 is in a gateway closing position therefor, such that with an end 46 thereof secured to the base plate 27 for the anchor post 24 the cable is extendible upwardly in succession through the end rings 34 on the end post 21 and then about the pulleys 38 of the pulley units 36 and 37 for attachment of its opposite end 47 to the top plate 28 on the anchor post 26. In a gateway closing position, therefor, the pulley units 36 and 37 are adjacent the upper ends of the end posts 21 and 22, and the cable portion 50 is extended horizontally between the pulley units 36 and 37 above the uppermost one of the chain members 23, at a position adjacent the top ends of the end posts 21 and 22. With the cable portion 50 thus positioned the chain members 23 are arranged in a vertically spaced relation longitudinally of the end posts by their interconnection with the lift chains 42.

Figure 5:
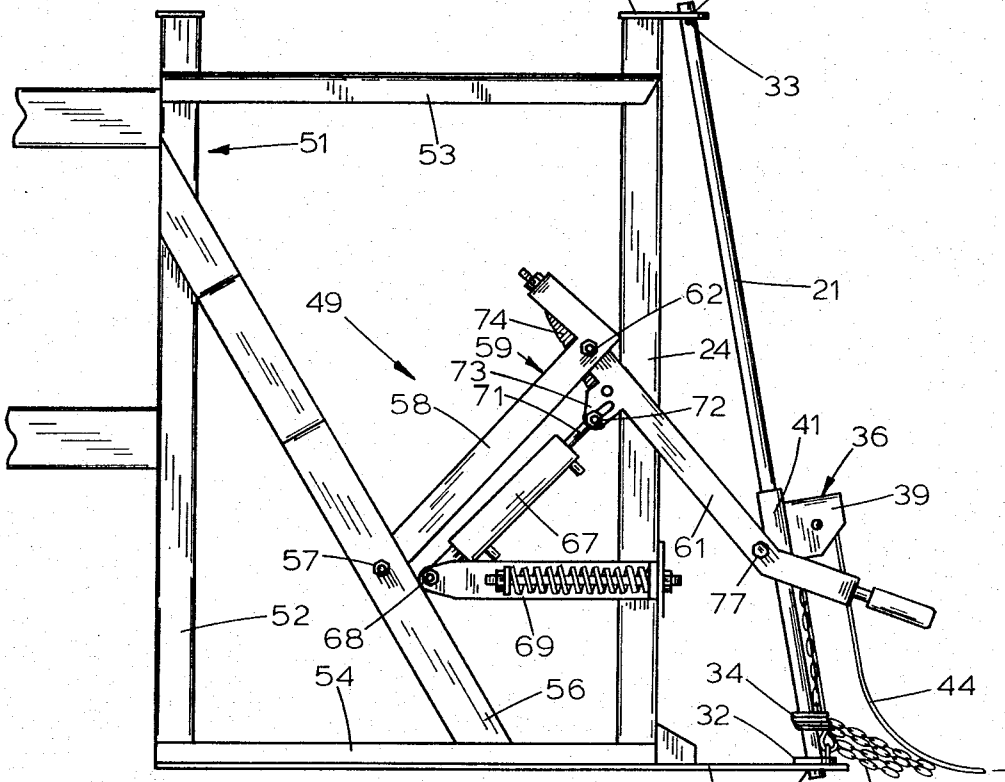
FIG. 5 is illustrated similarly to FIG. 1 and shows the chain gate in the gateway opening position therefor.

On a lowering of the pulley units 36 and 37 on the end posts 21 and 22 to open the gateway, indicated at 48, the pulley units are permitted, by the action of the lift cable 44, to drop concurrently or in unison on the end posts to the lower positions therefor shown in FIG. 5. In this lowered position of the pulley units 36 and 37, the chain members 23 are loosely extended between the lower ends of the end posts 21 and 22 to form a compact mass on the ground providing for a safe travel thereover, through the gateway 48.

On a raising or lifting of the pulley unit 36 to close the gateway 48, the cable 44 functions to raise the pulley units 36 and 37 in unison. By virtue of the attachment of the lift chains 42 with the pulley units and their interconnection with the end rings 34 on the chain members 23 the chain members are thus elevated in succession from their ground positions and moved upwardly on the end posts 21 and 22 to the gateway closing position therefor shown in FIG. 1 extended horizontally between the end posts in a vertically spaced relation.

As shown in FIG. 1, the chain members 23 vary in length from the lowermost chain member to the uppermost chain member with the difference in the lengths of the chain members being dependent on their vertical positions when the chain gate 20 is in a gateway closing position. As a result of this variation in length of the chain members and the upwardly diverged relation of the end posts 21 and 22 the chain members, when the pulley units 36 and 37 are elevated on the end posts, are lifted in succession by the lift chains 42 and progressively extended during their upward movement on the reversely inclined end posts so as to be under tension and taut between the end posts in their elevated gateway closing positions.

It will further be seen that on the lowering of the pulley units 36 and 37, the chain members 23 tend to collapse and drop inwardly between the end posts so as to remove any tendency of the ring members 34 to bind upon the end posts. This free drop of the chain members 23 also assists the downward movement of the pulley units on the end posts 21 and 22 to their lowered positions shown in FIG. 5.

It is seen, therefore, that the chain gate 20 is of a simple and compact construction with the chain members 23 being interconnected by the lift chains 42 so as to be lowered and raised in succession in response to the concurrent movement of the pulleys 36 and 37 on their associated end posts 21 and 22, respectively. In their lowered positions, the chain members 23 form a compact mass on the ground surface to provide minimum obstruction to the passage of a vehicle or livestock through the gateway 48 and their pick up in succession for independent extension between the end posts reduces to a minimum any entanglement thereof during a gateway closing operation. This successive lifting of the chain members 23 and their progressive extension on the reversely inclined end posts to final taut positions extended therebetween provides for a substantially rigid barricading of the gateway 48 by the flexible chain members.

In the operation of the chain gate 20, the pulley unit 36 may be manually or power operated from either side of the chain gate 20. For a power operation of the chain gate 20 there may be provided a hydraulically actuated lift mechanism 49 (FIG. 1) comprised of a stand or frame structure 51 that includes the anchor post 24 and an associated upright post member 52 which are interconnected by upper and lower horizontal frame members 53 and 54, respectively. It is to be understood that the frame structure 51 extends in substantial longitudinal alignment with the chain gate 20. Brace members 56 extended diagonally between and connected to the post member 52 and the lower frame members 54 pivotally support at 57 an inner section 58 of an articulated lift arm 59 that additionally includes an outer section 61. The adjacent ends of the sections 58 and 61 are pivotally interconnected at 62 with each of the sections 58 and 61 being formed of a pair of transversely spaced like strap members 63 and 64, respectively. As best appears in FIG. 4, the strap members 63 adjacent the pivot 62 are connected together by a laterally projected inverted U-shape section or bridge 66.

Figure 4:
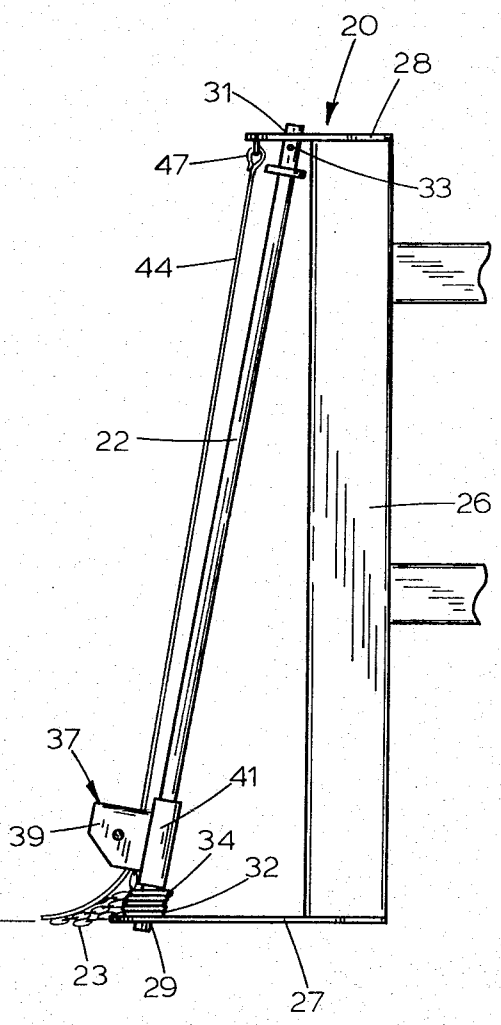
FIG. 4 is an enlarged sectional detail view of a lift arm as seen on the line 4—4 in FIG. 1.
Figure 4:
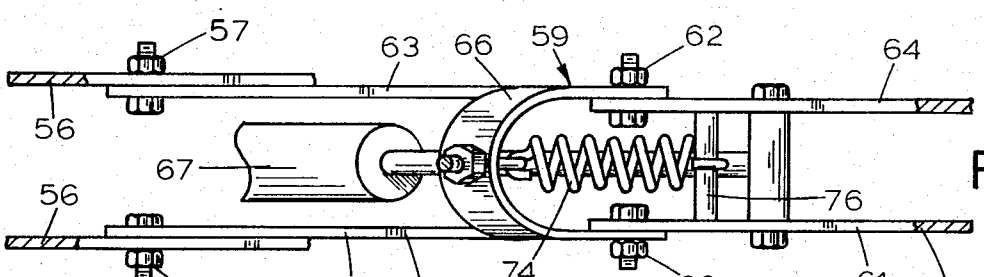

The lift arm 59 is actuated by a hydraulic cylinder assembly 67 to raise and lower the chain gate 20 to gateway opening and closing positions therefor. The operating cylinder 67 has the closed end of the cylinder thereof pivoted at 68 (FIGS. 1 and 3) to a spring unit 69 laterally projected from and movably supported on the anchor post 24 for a limited yieldable movement of the cylinder 67 in a direction axially thereof. The spring unit 69 includes a pair of arms 70 arranged at opposite sides of the anchor post 24 and supported on the post 24 for yieldable up and down movement against the action of associated compression springs 75. The opposite or piston rod end 71 of the operating cylinder 67 is pivoted at 72 in a lost motion connection with ear members 73 projected laterally from the strap members 64 of the outer arm section 61 (FIGS. 4 and 5).

Figure 6:
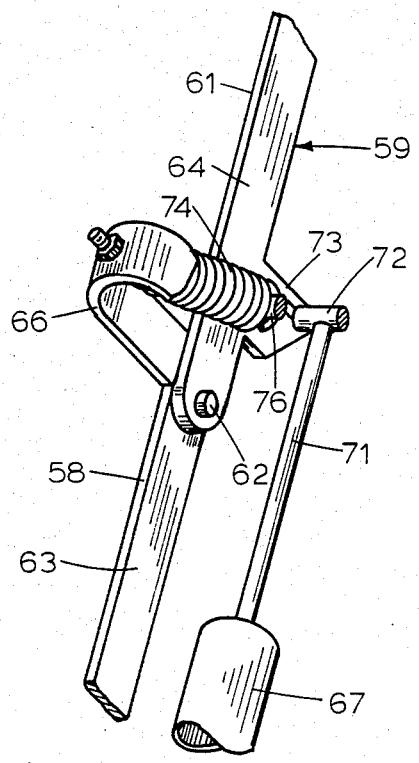
FIG. 6 is an enlarged perspective detail view showing a lift arm, that forms part of a lift mechanism for operating the chain gate, in the gateway closing position of the gate chain.
Figure 7:
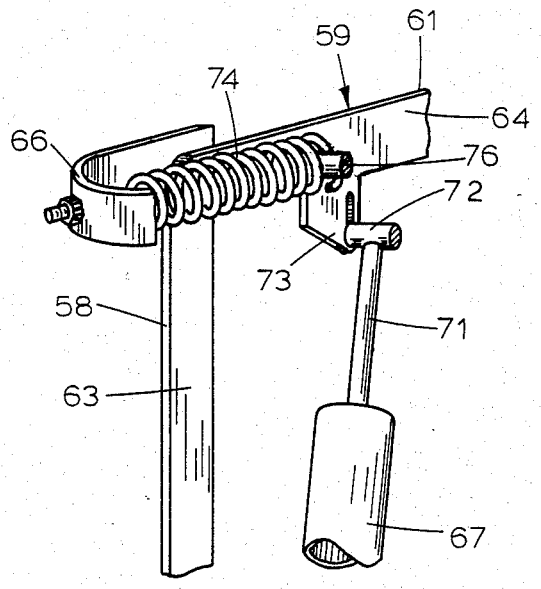
FIG. 7 is illustrated similarly to FIG. 6 and shows the lift arm in an intermediate position therefor.

A coil spring 74 (FIGS. 4 and 5) is connected in tension to and extended between the bridge member 66 and a pin member 76 extended transversely between the ear members 73 to form with the pivots 62 and 72 a toggle joint with the adjacent ends of the lift arm sections 58 and 61. Thus, as shown in FIGS. 1 and 6, when the arm sections 58 and 61 are in linear alignment corresponding to the gateway closing position of the chain gate 20, the spring 74 acts to maintain such alignment by virtue of the location of the pivot 72 outwardly from the inner arm section 58, and pivot 62. This action of the spring continues until the outer arm section 61 and inner arm section 58 are relatively moved by the operating cylinder 67 to a neutral or intermediate position shown in FIG. 7 wherein the pivots 62 and 72 and the transverse pin or pivot 76 of the spring 74 are in substantial radial alignment relative to the pivot 62.

Figure 8:
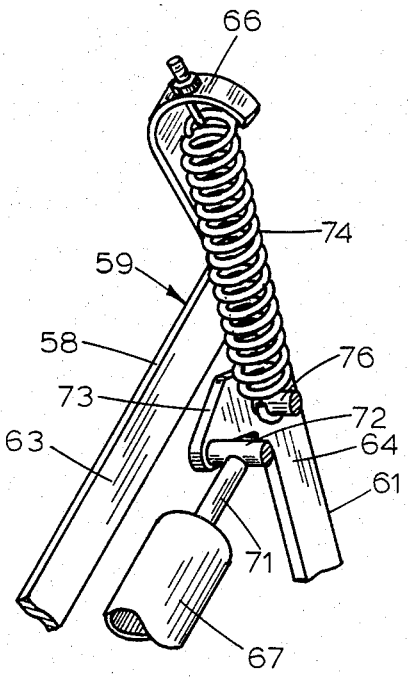
FIG. 8 is illustrated similarly to FIG. 6 and shows the lift arm in a gateway opening position.

On a continued downward bending movement of the lift arm 59 in response to the continued retraction of the operating cylinder 67 this radial alignment is broken and the pivot 72 moved inwardly of the inner arm section 58, as shown in FIGS. 5 and 8, to a lowered position of the lift arm 59 corresponding to a gateway opening position of the chain gate 20. The spring 74 then acts to maintain the bent or unfolded position of the lift arm 59 until the outer arm section 61 is moved through the neutral position therefor shown in FIG. 7 and toward the position of FIG. 6 at which time the spring 74 will function to move the outer arm section 61 into longitudinal alignment with the inner arm section 58 (FIG. 6).

Figure 9:
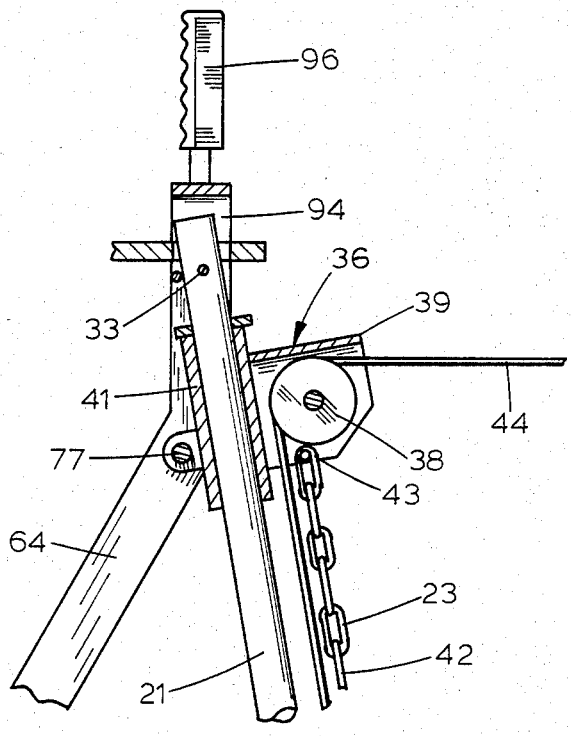
FIG. 9 is an enlarged detailed sectional view showing the connection of the lift arm of the lift mechanism with a cable and pulley system that is associated with the chain members of the gate to control the raising and lowering movements thereof.

The outer ends of the strap members 64 of the outer arm section 61 are pivotally connected at 77 to the housing 39 of the pulley unit 36 (FIGS. 1 and 9). Movement of the lift arm 59 between the positions therefor shown in FIGS. 1 and 5 in response to actuation of the operating cylinder 67 moves the pulley unit 36 in a direction longitudinally of the end post 21 to operate the chain gate 20 in the manner previously described. In this respect, it will be noted that the lift arm pivots 57, 62 and 77 coact with the lost motion connection 72 to provide for such movement of the pulley unit 36 longitudinally of the end post 21. It will be further noted that the yieldable pivot 68 permits variations in the linear extension of the operating cylinder 67 to assure movement of the lift arm 59 to the upper and lower positions therefor. Stated otherwise, if the lift arm 57 is fully extended, the cylinder 67 may be further extended without injury to the lift mechanism 49.

Figure 10:
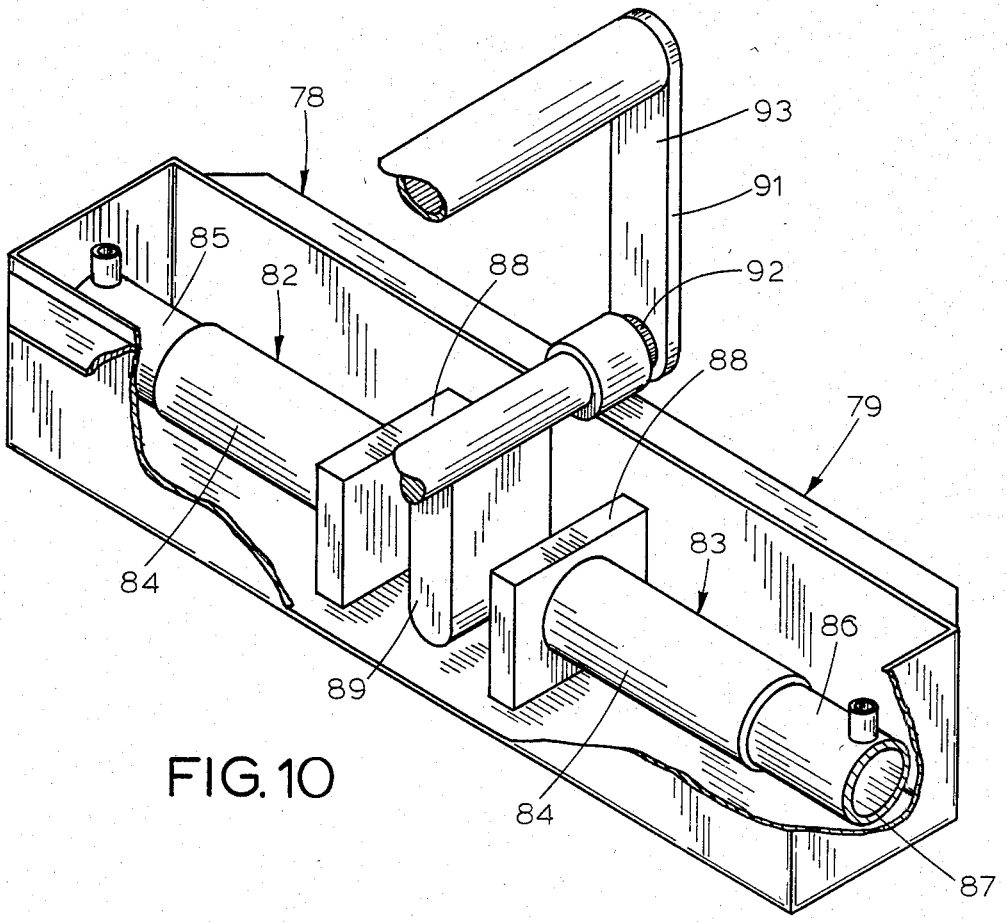
FIG. 10 is an enlarged perspective view, with some parts broken away, of a hydraulic actuating unit providing for the operation of the lift mechanism.
Figure 11:
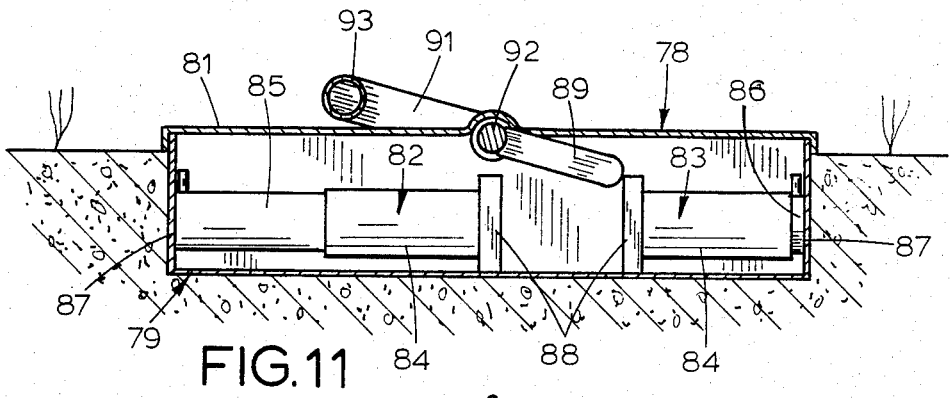
FIG. 11 is a reduced longitudinal sectional view of the control unit of FIG. 10, illustrated in one actuating position therefor.

The chain gate 20 is operable from either side thereof in response to a vehicle travel through the gateway 48 by the provision of a similar pair of control units 78 and 78*a* (FIG. 12) with only the control unit 78 being illustrated in FIGS. 10 and 11. For convenience of description, like parts will be designated by like numerals with the suffix a indicating like parts of the control unit 78*a*.

The units 78 and 78*a* are arranged to opposite sides of the gateway 48 and as shown for the unit 78 in FIGS. 10 and 11, each includes a box-like housing 79 having an open top closed by a cover 81. A pair of like actuating cylinder assemblies 82 and 83 are arranged in longitudinal alignment within the housing 79 between the end walls thereof. Each unit 82 and 83 includes tubular pistons 84 in telescopic engagement with a tubular cylinder 85 and 86 each of which has an outer end 87 secured in a fluid tight relation with an adjacent end wall of the housing 79. The free end of the piston 84 is closed by an abutment plate 88 that is engageable with an inner section 89 of a lever 91 which is pivoted intermediate the ends thereof at 92 to the top side of the housing 79 for swinging movement into engagement with one or the other of the abutment plates 88. As shown in FIG. 10, for a neutral position of the lever 91 the inner lever section 89 is projected downwardly intermediate the abutment plates 88 with an outer lever section 93 projected upwardly from the housing 79. This neutral position is attained by constructing the lever section 89 as a counterweight relative to the lever section 93. With the housing 79 buried in the ground (FIG. 11) with only the cover 81 exposed the lever section 93 projects upwardly to be engaged and swung downwardly by a vehicle wheel passing thereover.

Figure 12:
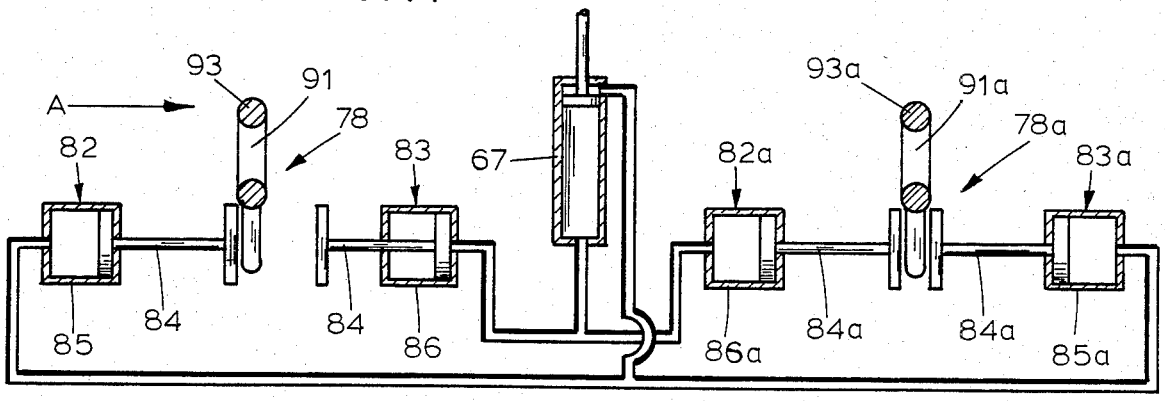
FIG. 12 is a diagrammatic illustration of the hydraulic operating system for the lift mechanism showing the positions thereof when the gate chain is in a gateway closing position therefor.

As shown in FIG. 12, the control units 78 and 78*a* and their cylinder assemblies 82, 83 and 82*a* and 83*a*, respectively, and the operating cylinder 67 are shown in their relative positions corresponding to a gateway closing position of the chain gate 20. The cylinders 85 and 85*a* are fluid connected with one end of the operating cylinder 67 and the cylinders 86 and 86*a* with the opposite end thereof. The hydraulic system is filled with oil or like liquid except for the cylinder 86.

Figure 13:
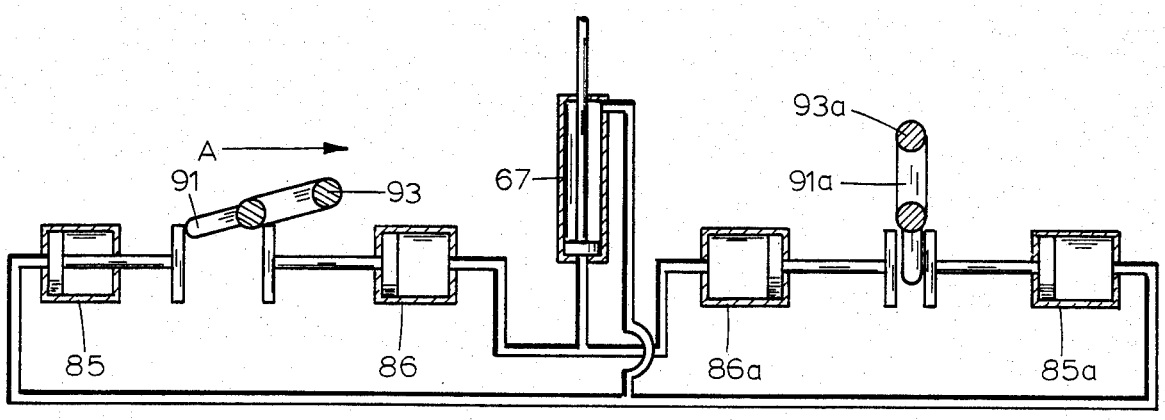
FIGS. 13 and 14 illustrate changed positions of the hydraulic operating system providing for the continuous passage of a vehicle through the gateway in one direction of travel.

Let it be assumed that a vehicle is to travel through the gateway in the direction of the arrow A shown in FIG. 12. As a vehicle wheel engages and moves the lever section 93, such section is swung downwardly to engage and depress the piston 84 of the cylinder 85 whereby fluid from the cylinder 85 is transferred to the operating cylinder 67 to retract the piston thereof. The lift arm 59 is thus actuated to move the pulley unit 36 from its position in FIG. 1 to the gateway opening position thereof shown in FIG. 5. During this retraction of the operating cylinder piston the fluid from the operating cylinder 67 is transferred into the cylinder 86, all as shown in FIG. 13.

Figure 14:
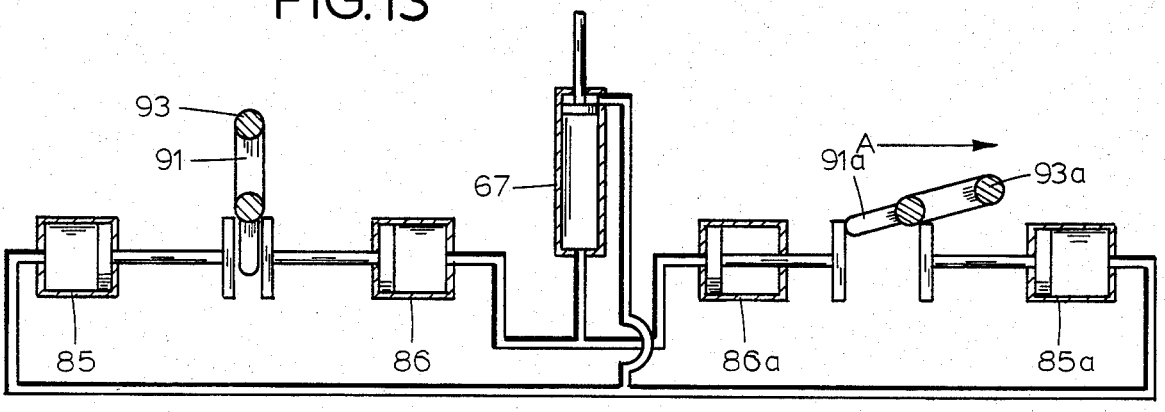

As the vehicle continues its travel through the gateway the lever 91 is returned to its upright position shown in FIG. 14 and lever section 93*a* of the lever 91*a* is actuated by a vehicle wheel to engage the abutment plate 88*a* of the piston 84*a* of the cylinder 86*a* to displace the fluid therefrom into the operating cylinder 67 whereby to extend the operating cylinder piston rod and move the lift arm 59 to its elevated position to close the gateway 48. Fluid thus displaced from the operating cylinder 67 is transferred to the cylinder 85. On release of the lever 91*a* the control units 78 and 78*a* are returned to the positions thereof in FIG. 12.

Figure 15:
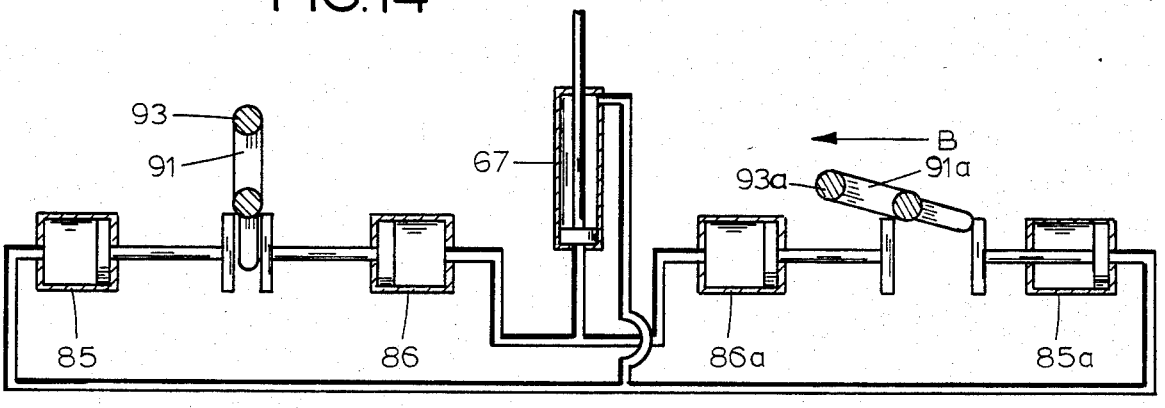
FIGS. 15 and 16 illustrate the changed positions of the hydraulic operating system for the continuous passage of a vehicle through the gateway in a direction opposite the direction illustrated in FIGS. 13 and 14.
Figure 16:
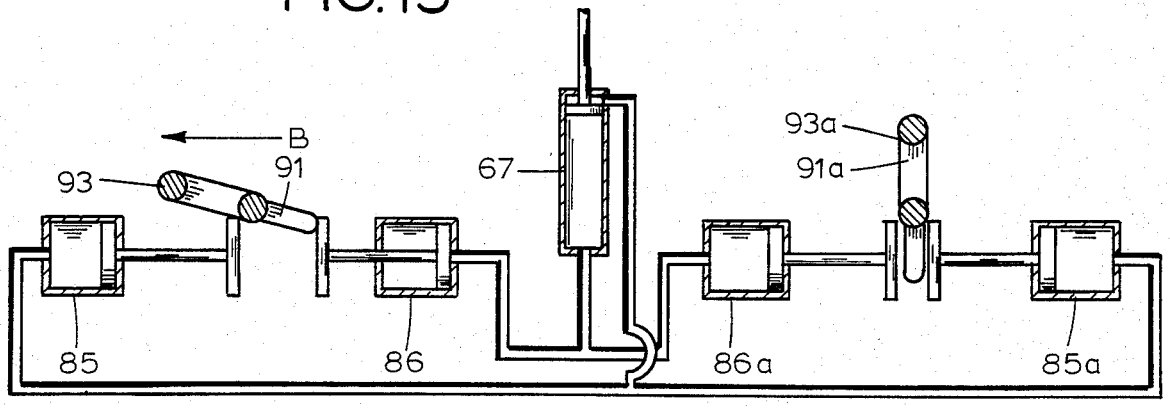

In a similar manner when a vehicle travels through the gateway in the direction of the arrows B in FIGS. 15 and 16 fluid is initially displaced from the cylinder 85*a* (FIG. 15) and into the operating cylinder 67 to lower the lift arm 59. On passage of the vehicle through the gateway and into engagement with the lever section 93, oil (FIG. 16) is transferred from the cylinder 86 into the operating cylinder 67 to raise the lift arm 59 to its FIG. 1 position. The control system is then again returned to its neutral condition of FIG. 12.

To provide for a manual operation of the lift arm 59 the strap members 64 of the outer arm section 61 have their terminal ends connected by an inverted U-shape laterally offset member 94 arranged and constructed to move in a straddling relation over the pulley unit 36. A hand grip 96 projects outwardly from the U-shape connecting member 94 so that by merely grasping the hand grip 96 the lift arm 59 may be moved to the lowered and elevated positions therefor. During this manual movement of the lift arm 59 oil is merely idly passed through the hydraulic control system in response to the actuation of the operating cylinder 67 by the lift arm.

Although the invention has been described with respect to a preferred embodiment thereof, it is to be understood that modifications can be made therein which are within the full intended scope of the invention as defined by the appended claims.

I claim:

1. A chain gate for a gateway defined by a pair of upright horizontally spaced anchor members comprising:

(a) a chain structure for opening and closing said gateway including a pair of end posts corresponding to said pair of anchor members with each end post located adjacent to and inwardly of an associated anchor member and inclined upwardly and toward the anchor member, (b) means for securing each end post to an adjacent anchor member, (c) a plurality of chain members extended between said end posts in a vertically spaced relation to raised positions therefor to close said gateway with the uppermost one of said chain members adjacent the upper ends of said end posts, and to lowered positions extended between the lower ends of said end posts to open said gateway, (d) means connecting the ends of said chain members to said end posts for up and down movement thereon, (e) flexible means interconnecting adjacent ends of said chain members whereby on movement of the uppermost one of said chain members from the gate opening to the gate closing position therefor the remaining chain members are sequentially moved thereby to the gateway closing positions therefor, said chain members having varying lengths relative to the inclination of said end posts to provide for their taut extension between the end posts in the gate closing positions therefor, and (f) means for raising and lowering said uppermost chain member.

2. A chain gate according to claim 1, wherein:

(a) said connecting means are ring members attached to the ends of each chain member to loosely receive an associated end post therethrough, and (b) means for connecting said flexible means to said ring members.

3. A chain gate for a gateway according to claim 1, wherein:

(a) said raising and lowering means includes a pulley unit movably mounted on each end post for up and down movement thereon, (b) a flexible cable means having one end attached adjacent the lower end of a first one of said end posts and trained about the pulley unit on said first end post and extendible across said gateway and trained about the pulley unit on the second one of said end posts for attachment of the other end thereof adjacent the upper end of the second end post, and (c) a lift mechanism arranged adjacent said one end post member having a lift arm connected to the pulley unit thereon.

4. A chain gate for a gateway according to claim 3, wherein:

(a) said lift mechanism includes a power unit for operating said lift arm, and (b) means for actuating said power unit including a control unit arranged to each side of said gateway.

5. A chain gate for a gateway according to claim 4, wherein:

(a) each control unit is arranged beneath the ground surface and includes an actuating member projected upwardly from said surface for engagement by the wheel of a vehicle, whereby to actuate said power unit in response to a vehicle traveling through said gateway to sequentially open and close said gateway.

* * * * *